United States Patent [19]

Rosberg et al.

[11] Patent Number: 4,523,497

[45] Date of Patent: Jun. 18, 1985

[54] APPARATUS FOR REMOVING CONTAINER CAPS

[76] Inventors: Carl H. Rosberg; Hazel N. Rosberg, both of 111 Airport Rd., Hyannis, Mass. 02601

[21] Appl. No.: 496,231

[22] Filed: May 19, 1983

[51] Int. Cl.[3] ..... B67B 7/00

[52] U.S. Cl. ..... 81/3.44

[58] Field of Search ..... 81/3.34, 3.4, 3.42, 81/3.44

[56] References Cited

U.S. PATENT DOCUMENTS 3,862,776 1/1975 Sims et al. ..... 81/3.44 X 4,414,865 11/1983 Brooks et al. ..... 81/3.34 X

FOREIGN PATENT DOCUMENTS 389544 3/1933 United Kingdom ..... 81/3.44

*Primary Examiner*—James G. Smith

*Attorney, Agent, or Firm*—Hamilton, Brook, Smith & Reynolds

[57] ABSTRACT

Apparatus for use in removing container caps and especially screw cap elements which may be tightly engaged with the top of a container body. The apparatus comprises a housing having a base and side wall means arranged to form an enclosure within which a pair of fixed cap gripping jaws are secured by means of a spacer and divider plate elements in spaced relation to one another. The several components are further arranged to define cap receiving spaces occurring in two different levels in the housing capable of accommodating a wide range of cap sizes. Rotatably attached to the base at one side thereof is a flat handle element whose outer end projects from the housing to provide a grip.

The handle member is constructed with cap gripping jaw parts which may be moved, together with the handle, toward and away from respective fixed jaw portions. The housing is constructed for use in either one of two ways. The housing may be secured by fastenings to the underside of a shelf or cover or the like. In such case the container cover is gripped by the handle and the container may be manually turned. In another mode, the housing may be placed over a container which is at rest and the housing is then manually turned with the aid of finger grips formed along the outer surface of the side wall.

9 Claims, 7 Drawing Figures

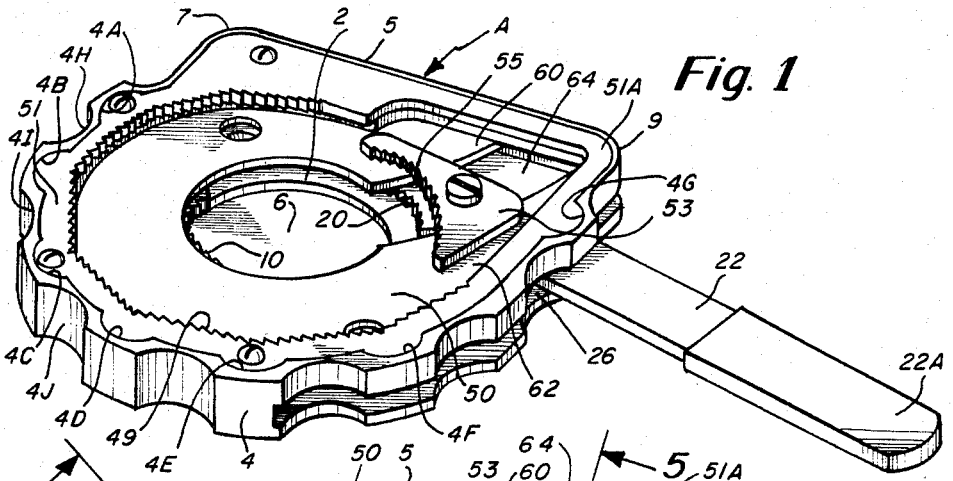
Fig. 1
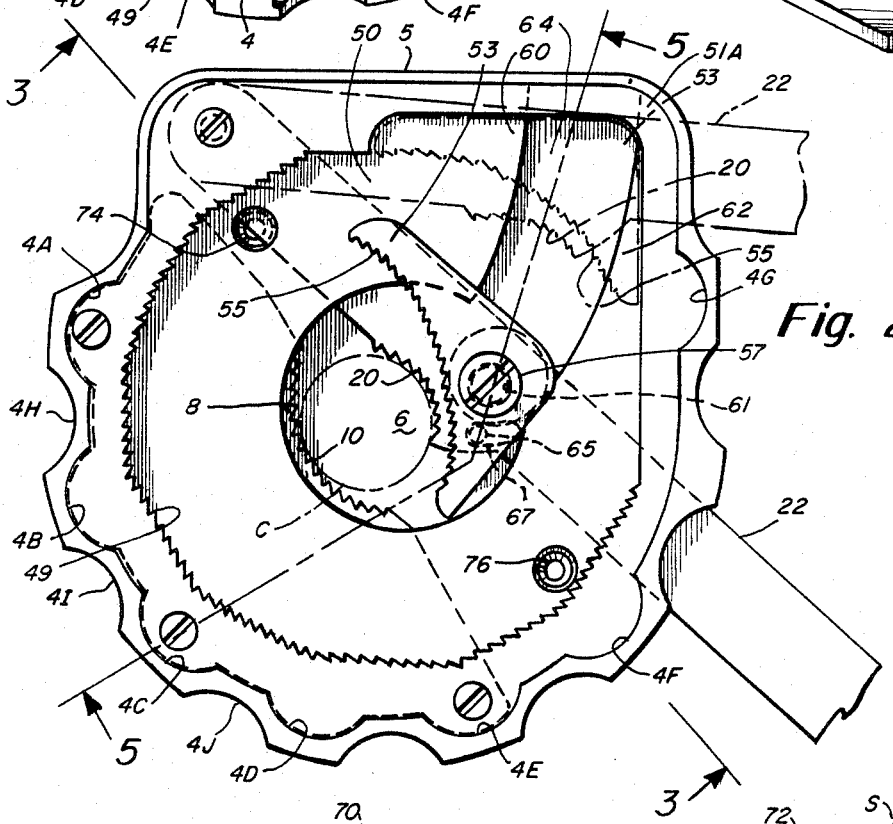
Fig. 2
Fig. 3
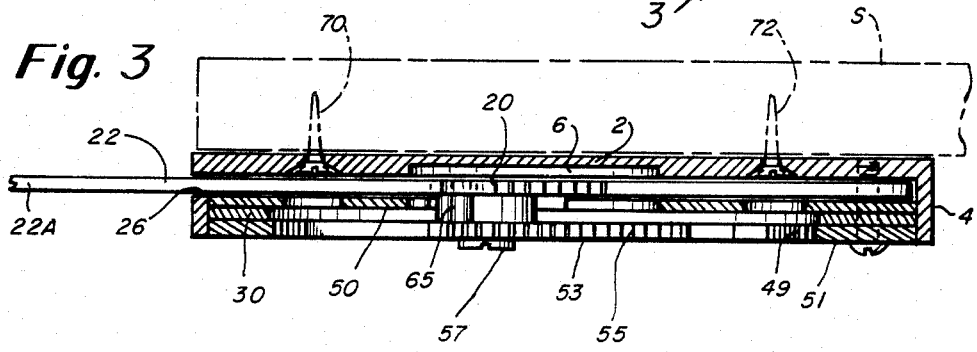

4
51
49
50
10
C
2
20
65
55
6
59
22
57
53
30
5
B

APPARATUS FOR REMOVING CONTAINER CAPS

FIELD OF THE INVENTION

In packaging a wide range of products to be offered to consumers one desirable and widely used packaging means consists of a container body having a container cap, or cover, engaged around the top thereof. It is customary to secure the cap sufficiently tightly so that resistance to removal of the cap may be of a considerable order of magnitude and exceeding the gripping capabilities of many individuals.

To deal with this problem, various cap removing devices have been proposed in the art. All of these prior art devices are provided with both fixed and movable jaw parts which may be utilized in gripping a container cap. However, where the cap means occurs in a varying range of sizes most of these prior art devices are either cumbersome to use or incapable of properly accommodating some sizes of caps and thus there exists a need for combining in a single cap removing apparatus a plurality of gripping mechanisms having greater versatility.

SUMMARY OF THE INVENTION

This invention relates to apparatus for removing container caps which are tightly engaged around the top of a container body. More particularly, the invention is concerned with a cap removing device which may be held and applied with one hand while the other hand is utilized to grip the body of a container.

A chief object of the invention is to provide an improved cap remover apparatus and to devise an arrangement of parts by which a container cap may be located in either one of two cap receiving apertures as determined by the relative size difference in a particular container cap dealt with.

Another object of the invention is to devise a unique arrangement of inner and outer cap gripping jaw portions which are solidly secured in a housing body at two different levels and to combine therewith a handle member having cap gripping jaw sections which may be moved with the handle into positions of gripping relationship with respect to the fixed jaw portions.

Still another object of the invention is to provide a housing body in which a plurality of jaw members and jaw locating components may be secured in interlocking relationship and solidly fastened together by simple fastening means such as rivets.

In one desirable arrangement of parts the cover removing apparatus of the invention provides a means of realizing the foregoing objectives by combining in a housing body fixed cap gripping jaw portions and movable cap gripping jaw portions which may be selectively employed to accomodate a range of cap sizes both with respect to varying cap diameters and varying axial depths of cap bodies.

The housing is characterized by a base of a magnitude exceeding most commonly used container cap sizes. A cap receiving aperture of relatively small size is formed centrally in the base and extending around the base is a rim or side wall which defines an enclosure space in which the jaw portions and other invention components are received in superimposed relationship to one another in a manner such that a second cap receiving aperture is provided to accomodate relatively large caps.

These components and their arrangement in the housing, in one preferred embodiment, are shown in the accompanying drawings are described in detail as noted below.

BRIEF DESCRIPTION OF THE DRAWINGS

FIG. 1 is a perspective view showing the cap removing apparatus of the invention.

FIG. 2 is a plan view of the apparatus of FIG. 1.

FIG. 3 is a cross-section taken on the line 3—3 of FIG. 2.

DETAILED DESCRIPTION OF THE INVENTION

The apparatus of the invention in one preferred embodiment includes generally a housing body in which two sets of cap gripping jaws are contained together with handle means for selectively positioning each set in cap gripping relationship to one another.

In combination with the two sets of jaws are spacer and divider means which locate the jaws in desired positions of adjustment and which further function to define inner and outer cap receiving apertures of differing size.

The invention apparatus, although not limited thereto, is further provided with a housing body characterized by a side wall construction having spaced apart indentations by means of which fixed jaw elements, as well as the spacer and divider means noted, may be contained in interlocking relationship one upon another and secured by a single set of fastening means as hereinafter described.

Figure 4:
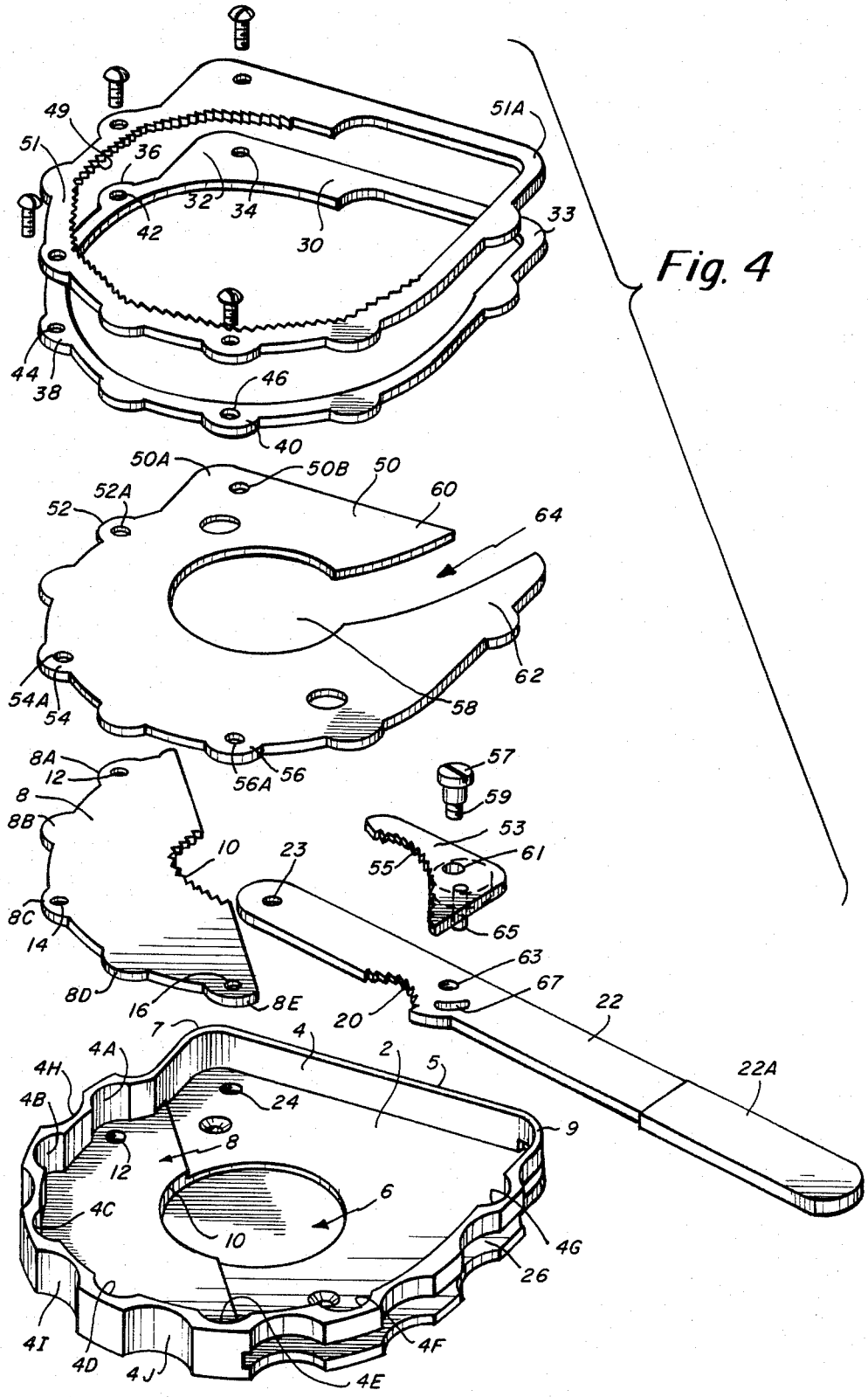
FIG. 4 is an exploded view of the various components of the cap removing apparatus of FIG. 1.

Referring in more detail to the drawings, the cap removing apparatus is shown in perspective in FIG. 1 and is generally denoted by the arrow A. In FIG. 4 the various components of the apparatus of FIG. 1 are shown in separated relationship to one another. As indicated therein, the apparatus includes a housing body consisting of a base 2 and a curved rim or side wall portion 4 which extends around the base 2 to define an enclosure of a magnitude which may be chosen to exceed in size, most if not all, of the standard sizes of container caps. The side wall may also include a linear portion 5 defining corners as 7 and 9. Formed centrally in the base is a relatively small cap receiving aperture 6. Also formed along the inner surface of the side wall 4 are a plurality of spaced apart indentations as 4A, 4B, 4C, 4D, 4E, 4F and 4G and in one preferred form the indentations may be of a semi-circular configuration, as illustrated.

As hereinafter described in more detail, the spaced apart indentations are designed to receive and hold the invention components in fitted, interlocking relationship with the side wall 4. It may also be desired to form the outer surface of the side wall 4 with finger slots as 4H, 4I, 4J etc.

In constructing the base and side wall structure described, any suitable method of fabrication may be employed. However, in one preferred form the structure may be a die casting and may be formed of a metal such as aluminum and the aluminum may be anodized.

In accordance with the invention an inner fixed jaw element 8 made of steel is located on the base 2 and is formed with jaw teeth 10. The jaw element 8 is most clearly shown in FIG. 4 and, as noted therein, is formed with an outer edge configuration characterized by spaced apart semi-annular projecting parts as 8A, 8B, 8C, 8D and 8E which mate with the indentations A, B, C, D and E, and through which fastening means such as screws, rivets or the like may be received to secure the jaw element 8 in a fixed position on the base.

In combination with this fixed jaw element 8 is provided movable jaw means 20 formed integrally along one edge of a handle member 22, as suggested in FIG. 4. The end of the handle 22 is formed with a hole 23 which is arranged to communicate with a hole 24 formed through the base 2 to receive a fastening pin, screw, or rivet element about which the handle 22 may be rotatably mounted on a portion of the base lying at an opposite side of the cap receiving aperture 6. The handle 22 is constructed of a thickness substantially corresponding to the thickness of the fixed jaw element 8 and at the outer end of the handle is formed a grip 22A which extends outwardly through an opening 26 in the side wall 24, as is best shown in FIG. 4. When the handle 22 is rotated by the grip 22A it will be apparent that the jaw means 20 may be moved toward and away from the fixed jaw 8 into positions for engaging a range of container cap sizes engaged in the cap retaining aperture 6. It will be understood that the jaw means 20, as well as the jaw element 8, may be constructed of a hardened steel.

Rotative movement of the handle 22 along the base 2 is guided by a spacer member 30, earlier referred to, and may consist of a thin plate of aluminum, as best shown in FIG. 4. The spacer member is superimposed on the fixed jaw element 8 and has an outer edge configuration which coincides with and fits snugly inside of the indented side wall 4. It will also be noted that spacer member 30 includes corner portions 32 and 33 which coincide with the corner portions 7 and 9 in the side wall 4.

Formed through the corner portion 32 is a hole 34 which communicates and registers with hole 24 in the base 2 and hole 23 in the end of the handle 22. The spacer member 30 is formed with projections as 36 which interlock with semi-annular spaces as 4A, 4C, 4E to resist turning movement within the side wall 4 and portions of the spacer member extending beyond the fixed jaw element 8 overlie the upper side of the handle 22 so that the handle may be freely rotated toward and away from the fixed jaw element 8. The spacer member is also formed with holes as 42, 44, and 46 which communicate and register with holes 12, 14 and 16 in the fixed inner jaw and well as underlying holes in the base 2.

Supported at the upper side of the spacer member 30 is an outer fixed jaw assembly which includes a fixed jaw element 51 and an underlying divider part 50. The jaw element 51 is formed with hexagonally shaped sets of jaw teeth 49 preferably of hardened steel.

These components are constructed of a thickness such that they substantially fill in the enclosed space of the side wall 4 with the upper surface of the fixed jaw element 51 lying flush with the top edge of the side wall 4, as more clearly shown in FIG. 1.

Arranged to cooperate with the fixed jaw element 51 is a movable jaw part 53 of steel having an arcuate row of jaw teeth 55. This movable jaw part 53 is mounted on the handle 22 in a raised position with respect to the upper side of the handle. Such spacing may be accomplished, for example as shown in FIG. 4, by means of a shoulder bolt as 57 having a lower threaded end 59 which may be received through an opening 61 in the jaw part and engaged in a threaded opening 63 in the handle. At the lower side of the jaw part 53 is a guide pin 65 which is arranged to be slideably received in a guide slot 67 in handle 22. By means of this arrangement the jaw part 53 may be turned into positions of adjustment with respect to any one of the hexagonal sections of teeth in the fixed jaw 51.

Considering in further detail the construction of the divider part 50, as is most clearly shown in FIG. 4, an outer edge of this member is formed with projections as 52, 54, and 56 which coincide with indentations in the side wall 4. Located through the projections 52, 54 and 56 are holes as 52A, 54A and 56A. At its opposite side, as viewed in FIG. 4, the divider part 50 is further formed with a linear edge 50' which merges whith a corner portion 50A and which in turn coincides with corner portion 32 of spacer element 30 on which it is received. Located through this corner portion 50A is a hole 50B which overlies and registers with holes 32, 23 and 24 of underlying components noted above.

Similarly, holes 52A, 54A and 56A overlie and communicate with openings 42, 44 and 46, as well as openings 12, 14 and 16 to receive fastenings therethrough.

An inner portion of the divider part 50 is formed with an opening 58 of a size similar to that of the aperture 6. Extending away from the aperture 58 are guide portions 60 and 62 which are spaced apart to define an arcuate guide slot 64. The thickness of divider part 50 and its guide parts 60 and 62 is slightly less than the space between the movable jaw 53 and the top of handle 22 and the width of the guide slot 54 is of a size to freely receive therethrough the cylindrical part of the shoulder bolt 57 when the guide parts 60 and 62 are located below the movable jaw 53, as i11ustrated in FIG. 1.

It will be observed that the divider part 62 as well as part 60, in the fully installed position shown in FIG. 1 extend into close proximity to the corner 51A of the fixed jaw member so as to provide for a corner part 55 of the movable jaw part to fit snugly into the corner portion 51A of the outer fixed jaw member 51 in a fully retracted position of handle 22.

In utilizing the cap remover apparatus abovedescribed either one of two procedures may be followed. In one desirable mode, as earlier noted, the apparatus may be secured to the underside of a shelf, cabinet or other horizontally disposed surface. Such an arrangement is illustrated in FIG. 3 in which a shelf or other supporting means, as indicated in broken lines and denoted by the letter S, fastenings as 70 and 72 are located through the holes as 74 and 76 to secure the apparatus in place.

Figures 5, 6, 7:
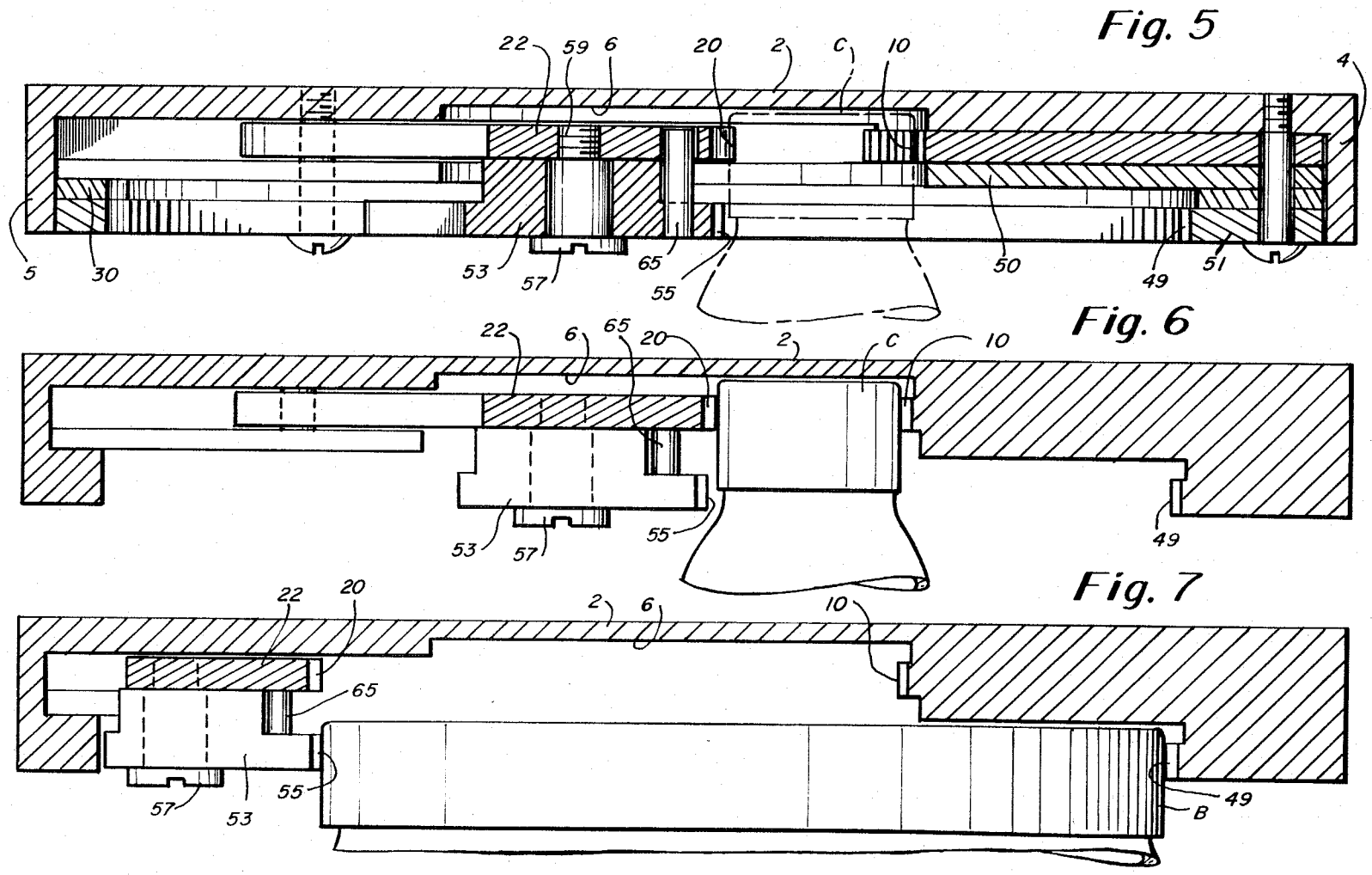
FIG. 5 is a view taken on the line 5—5 of FIG. 2 partly in cross-section and indicating schematically a container and cap located in a cap receiving aperature.
FIG. 6 is a view similar to FIG. 5 illustrating a container engaged by cap gripping jaws.
FIG. 7 is a cross-section similar to FIGS. 5 and 6 but illustrating schematically a relatively larger container cap received in an outer cap receiving aperture in the housing and engaged by relatively large cap gripping jaws.

With this arrangement a container and cover C, indicated in broken lines in FIG. 5, is held in the left hand of the operator and the cover, if of a suitable size, is located in the aperture 6. The handle 22 is then rotated in a clockwise direction, as shown by FIG. 2, and this advances the movable jaw 20 against an edge of the cap C forcing it against the inner jaw part 10, as shown in FIG. 6. Thereafter, the container may be manually turned to remove the cover C.

In another mode of use the apparatus may be unattached to any surface and may be stored in a cabinet drawer or the like from which it may be removed and applied to a container manually.

In FIG. 7 there is illustrated diagrammatically a container B which is substantially larger in size then the container C and which is shown engaged by the movable outer jaw 55 and the fixed outer jaw 51. In this position, container B may be in contact with a portion of the upper surface of the divider 50 it will be noted. The two illustrations of FIGS. 6 and 7 are intended to be illustrative of the considerable range of cap sizes. For example, in one desirable form, the inner cap aperture may accomodate sizes up to $1\frac{1}{2}$ inches and the outer cap aperture may accomodate sizes up to $3\frac{1}{4}$ inches. Other sizes may be desired to be employed. It should also be noted that the various components with the holes formed therethrough which have been specified may all be solidly secured together as a single unit by means of fastenings, and in FIG. 4 screw fastenings are indicated for this purpose. It may also be found more desirable to secure the components together in other ways as by riveting the parts together. As earlier noted, if the apparatus is used by gripping it in one hand, then the finger slots shown around a portion of the outer side of the apparatus are conveniently employed to exert a turning force.

We claim:

1. Apparatus for removing a container cap, said apparatus comprising a housing, inner and outer cap gripper jaw means fixed in the housing in spaced apart relationship, a handle element rotatably mounted in the housing and having separated gripper jaw portions movable with the handle toward and away from respective fixed jaw means said outer fixed jaw means being supported on spacer and divider plate means and the seperated jaws portion associated with said outer fixed jaw means being supported on a bolt fastened to the handle, the bolt being guided through slot means formed in the divider plate.

2. The invention of claim 1 in which the housing is formed with a base having a cap receiving aperture formed centrally thereof and said inner fixed gripper jaw means being supported on the base and extending around a portion of the cap receiving aperture.

3. The invention of claim 2 in which the handle is formed along one edge with one of the said seperated gripper jaw portions and being arranged in a position to move into gripping relationship with the said inner fixed jaw portions.

4. The invention of claim 2 or 3 in which the base includes a side wall enclosure which extends around the base and is formed with an inner surface having indentations located therein and the inner and outer fixed jaw portions together with the spacer and divider plate means are secured in interlocking relation with the indentation of the said inner surface.

5. Apparatus for removing a container cap including a housing body having a base formed with a cap receiving aperture located centrally thereof, a side wall portion extending around the base at right angles thereto to form an enclosure space, inner surfaces of the wall portion being recessedd to provide spaced apart indentations, a handle member rotatably mounted in the base and extending outwardly through a slotted portion of the side wall to constitute a gripping end, a fixed jaw portion fitted in the indented surface of the side wall portion and received on the base and extending around a portion of the cap receiving aperture, a divider plate located on the fixed jaw portion and fitted against the indentation of the inner wall surface, a spacing plate superimposed on the divider plate and also fitted against indentations of the inner surface of the side wall and an outer fixed jaw element mounted on the spacer plate and interlocked with the indentations of the side wall, said handle having formed along one edge thereof a jaw section movable with the handle into a position of gripping relationship with the said inner fixed jaw portion and an outer jaw element supported on a bolt in spaced relation to the upper side of the handle and movable into a position of gripping relationship with the outer fixed jaw portion.

6. The invention of claim 5 in which the spacing plate is located in a position to cooperate with the outer fixed jaw member and define a relatively large cap receiving aperture.

7. The invention of claim 5 or 6 in which the outer fixed jaw portion is formed with hexagonally shaped jaw portions.

8. The invention of claim 5 in which the housing body and all of the enclosed components are secured together by common fastening elements located therethrough.

9. The invention of claim 5 in which the side wall portion is formed with outer finger slots for gripping purposes.

* * * * *